US005165883A

United States Patent [19]

Van Bemmel

[11] Patent Number: 5,165,883

[45] Date of Patent: Nov. 24, 1992

[54] APPARATUS AND METHOD FOR SAFE OPERATION OF KEROSENE HEATERS

[75] Inventor: Jan C. Van Bemmel, Leerbroek, Netherlands

[73] Assignee: Toyotomi Co. Ltd., Nagoya, Japan

[21] Appl. No.: 690,988

[22] PCT Filed: Oct. 26, 1989

[86] PCT No.: PCT/DE89/00692

§ 371 Date: Jul. 16, 1991

§ 102(e) Date: Jul. 16, 1991

[87] PCT Pub. No.: WO91/06808

PCT Pub. Date: May 16, 1991

[51] Int. Cl.[5] ..... F23N 5/20

[52] U.S. Cl. ..... 431/6; 431/22; 431/76; 431/78; 431/302; 126/96

[58] Field of Search ..... 431/12, 13, 18, 75, 431/76, 79, 78, 302, 22; 126/92 R, 92 AC, 95, 96

[56] References Cited

U.S. PATENT DOCUMENTS 4,392,813 7/1983 Tanaka et al. ..... 431/76
4,412,809 11/1983 Yamaguchi et al. ..... 431/76
4,451,228 5/1984 Wada et al. ..... 431/76
4,534,727 8/1985 Imajima ..... 126/96
4,770,628 9/1988 Ohkura ..... 431/76

FOREIGN PATENT DOCUMENTS

WO86/05860 10/1986 World Int. Prop. O. ..... 431/76

*Primary Examiner*—James C. Yeung
*Attorney, Agent, or Firm*—Notaro & Michalos

[57] ABSTRACT

A process and apparatus for monitoring and ensuring safe operation of unvented kerosene heaters in indoor spaces detects the hazard of incomplete combustion and the concomitant reduced $O_2$ and increased $CO_2$ levels in the indoor air. $CO_2$ level in the indoor air is monitored quickly and accurately, - regardless of the burner's flame height. This is achieved by sensing $O_2$ level in the burner exhaust which is used as a measure for monitoring the $CO_2$ level in the indoor air and as a control signal. During burner operation outside a predetermined flame height range, the $O_2$ detection is used both for restoring a normal heating condition and for monitoring operation at minimum flame height and to generate a warning signal and a delayed automatic shut-down of the burner.

15 Claims, 5 Drawing Sheets $CO_2$ % + CO % - $O^{-2}$

CO, $CO_2$ quantity CO, $O_2$-quantity during use of the petroleum furnace relative to $O_2$-% in the inside ambient air

APPARATUS AND METHOD FOR SAFE OPERATION OF KEROSENE HEATERS

FIELD AND BACKGROUND OF THE INVENTION

The invention relates to a process of monitoring and ensuring the safe operation of unvented stoves, particularly of kerosene heaters, within enclosed spaces both in the normal heating condition in which the height of the flame produced by the burner is within a predetermined range, and when radiation-responsive means detect flame heights outside said range, and in operation outside the normal heating condition, with flame heights higher or lower than the predetermined range causing corresponding control signals to be generated and to be coupled to an electronic control circuit so as to cause the normal heating condition to be restored, on the one hand, and to cause a warning signal to be generated and the burner to be shut down on the other, after a corresponding timeout in case the burner consistently operates outside the predetermined flame height range for a predetermined period of time.

Further, the invention relates to apparatus for practicing the inventive process.

The European countries have recently tightened safety regulations relative to indoor air pollution caused by unvented ovens and particularly by kerosene heaters; they require such unvented ovens—such as kerosene heaters with one- or two-stage burners—to be monitored strictly for safe operation (see U.S. Pat. No. 4,390,003).

There have been known safety systems for ovens and particularly for kerosene heaters (WO 86/05860) in which, once the oven or heater has attained its normal operation, the height of the flames the burner produces may exceed a predetermined range and/or the heating means as well as the burner head and the associated piping may heat up to the point where the oven assumes an undesirable operating condition. The prior safety apparatus includes sensing means for detecting flame heights higher than a predetermined maximum and for providing a corresponding measuring and/or control signal which is coupled to actuating means responsive thereto to return the kerosene heater to the desired operating state or to shut it down. For a kerosene heater with a one-stage burner, the sensing means in the prior safety apparatus comprises two light sensors or thermal radiation detecting sensors each associated with an upper or lower limit of said predetermined range of flame heights in the normal operation of the kerosene heater. The burner's wick is re-adjusted manually or in accordance with the measuring signals generated by the light sensors as the flame height exceeds the predetermined flame height range; alternatively, the burner is shut down positively by means of a drop bar as soon as the flame height has exceeded the predetermined flame height range continuously for a pre-determined period of time.

This prior safety apparatus is based solely on a radiation-responsive detection of flame height. However, it does not satisfy the latest safety regulations as it has a number of inherent uncertainties. For example, if the burner is operated from the beginning at the lowest possible flame height, this condition will not be detected by the light sensor associated with the lower limit of the predetermined flame height range. Once the burner has burned at its lowest flame height for an extended period of time because the user has forgotten to shut down the heater, for example, there exists a great danger of the indoor space air containing inadmissible levels of $CO_2$ since the absence of a light-responsive minimum flame height detection feature prevents the heater from being shut down automatically.

Since the wick fabric always includes irregularities, it is possible for the burner flame during normal heater operation to temporarily exceed the top limit of the predetermined flame height range—which may cause the prior safety apparatus to prematurely automatically shut down the burner although the maximum permissible $CO_2$ level in the indoor air has not yet been reached. In an oven or heater equipped with the prior safety device, such preliminary burner shut down results in the emission of foul smell and soot, since the hot burner piping does not have enough time to cool down sufficiently to prevent the kerosene still present in the wick fabric from being burned by the heat the burner pipe will radiate, so that an intensive smell will be emitted.

In indoor spaces where an unvented kerosene heater is being operated and air ventilation is not sufficient, the $CO_2$ will increase and the $O_2$ concentration decrease ($CH_4+2O_2 \rightarrow CO_2+2H_2O$). A lack of oxygen results in incomplete combustion, however, which results in increased CO and $CO_2$ levels. As a consequence, there exists a direct relationship between the $O_2$ and $CO_2$ or CO concentrations on the one hand and between the $CO_2$ and CO concentrations on the other. As the $CO_2$ level rises, so will the CO level.

Gas sensors of the type used in conjunction with microcomputers for automatically controlling air cleaning equipment or fans, detect via electric resistance changes, the amount of CO, $H_2$and a number of other organic components in gaseous environments such as kitchen vapors, cigarette smoke or automobile exhaust gases have been known per se (Figaro Eng. Inc., type TGS 800).

In medicine, it has been known to use $O_2$ sensors for monitoring the oxygen enrichment level in artificial respiration apparatus (U.S. Pat. No. 4,495,051). Such an $O_2$ sensor may have the form of a galvanic cell, for example, comprising a lead anode, an oxygen cathode made of gold and a weakly acidic electrolyte. A resistor and a thermistor for temperature compensation are connected between the cathode and the anode so that the galvanic cell in the form of a lead-oxygen battery discharges constantly.

SUMMARY OF THE INVENTION

The object underlying the invention is to provide a process of the nature specified above as well as apparatus for practicing that process which avoid the drawbacks stated above and which answer today's stringent safety requirements. In particular, kerosene ovens or heaters are to be monitored and to be operated safely in a manner not necessarily dependent on a radiation-responsive detection of flame height.

In accordance with the invention, the object underlying the invention is achieved by sensitively detecting the amount of $O_2$ in the burner off-gas or exhaust within the kerosene heater and using it as a measure for monitoring the amount of $CO_2$ in the burner off-gas and converting it into a voltage signal for use as a control signal. During burner operation outside the predetermined flame height range, the sensitive $O_2$ detection is used under program control for restoring the normal heating condition as well as for monitoring operation in the lowest flame height condition, with a warning signal being generated and a delayed automatic shut-down of the burner. effected, at predetermined first and second $O_2$ levels, respectively. This corresponds to predetermined amounts of $CO_2$ in the air within the indoor space, with the second level being lower than the first level.

In accordance with a preferred practice of the invention, the CO percentage is used additionally as a measure for monitoring the amount of $CO_2$ in the indoor air, and the warning signal is generated and the burner shut down automatically when the $O_2$ or CO in the burner off-gas has reached the level corresponding to the permissible maximum of 0.8% $CO_2$ in the indoor air.

Preferably, burner shut-down is effected automatically e.g. 90 sec. after the warning signal indicating too low an amount of $O_2$ or too high a CO-$CO_2$ level, has been issued.

The inventive safety apparatus for practicing the inventive process in unvented ovens and particularly in kerosene heaters is provided with sensing means comprising a light sensor mounted inside the housing of the kerosene heater in association with the upper limit of a predetermined range of flame heights determining the normal heating condition of the heater. A battery, electronic control circuitry coupled to the battery and adapted to cause wick adjustments, and light sensor for indicating flame height outside its predetermined range are also provided. The apparatus also includes warning means and means for automatically shutting down the burner both coupled with timing means incorporated in the electronic control circuit and actuatable in a time-offset manner when the burner is operated above the predetermined flame height range for a predetermined period of time. In accordance with the invention, the aforesaid safety apparatus is unique in that the sensor means additionally comprises an $O_2$ sensor coupled to a microprocessor mounted within the kerosene heater housing in the lower portion thereof and connected through the electronic control circuitry to the wick adjusting means, the warning means and the automatic burner shut-down means, with the warning means and the burner shut-down means operating in response to predetermined first and second $O_2$ levels in the burner off-gas, respectively, the second level being lower than the first level.

Advantageously, a CO sensor may additionally be provided on an electronic circuitry card mounted on a bracket in a top corner of the kerosene heater housing behind a screen for reflecting the heat radiated by the burner and having an opening such that a small portion of the off-gas stream passing through the opening in the reflecting screen may contact the CO sensor.

Using the inventive process and the inventive apparatus for practicing it, it is possible to operate unvented ovens and particularly kerosene heaters in indoor spaces and to correctly and consistently meet safety parameters even more stringently than the official safety regulations presently in force. In particular, accurate $CO_2$ monitoring does not necessarily have to rely on a detection of the burner's flame height.

For example, if the oxygen concentration in the air of an indoor space decreases, so will the flame height, meaning that e.g. in a two-stage burner kerosene heater the second burner stage does not operate any more, causing high CO emission and an increased $CO_2$ concentration in the indoor air. The inventive safety apparatus directly and accurately detects a decrease of the oxygen concentration inside the housing of the kerosene heater so that an increase of the $CO_2$ in the indoor air will be precisely detected. At the same time, the inventive safety apparatus is capable of accurately and directly detecting an increase CO concentration already in the interior of the housing of the kerosene heater and thus ensures an accurate monitoring of the minimum flame height of the kerosene heater's burner.

The inventive safety apparatus measures the $O_2$ concentration in the burner off-gases in the housing of the kerosene heater to detect the $CO_2$ concentration in the indoor air and converts the $O_2$ concentration to a voltage signal. The set value is the voltage corresponding to the maximum permissible $CO_2$ concentration in the indoor air, which for the inventive safety apparatus is defines as being 0.8%. When the $CO_2$ concentration in the indoor air exceeds 0.8% (according to the ratings established by the TÜV (Technical Inspection Association in West Germany), the maximum permissible level is 1%, the shut-down feature in the inventive safety apparatus automatically deactivates the burner. This means that the inventive safety apparatus operates well below the limit stipulated by applicable safety regulations.

The amount of $CO_2$ in the indoor air is measured by means of an $O_2$ sensor in the form of a galvanic cell which is mounted on a circuit board supported by the housing of the kerosene heater.

The following procedures are used to check the $CO_2$ concentration:

1. $CO_2$ is measured after a delay of e.g. 4 min. following the activation of the kerosene heater so as to allow the sensor voltage to settle.
2. Any alarm is delayed for e.g. 30 seconds to prevent transients from triggering the feature.
3. An intermittent buzzer signal, which may comprise three tones and lasts a maximum of 90 seconds is generated to indicate an excessive CO—$CO_2$ concentration in the indoor air. Within that period, indoor ventilation may be improved (e.g. by opening a door or a window) so as to reduce the CO—$CO_2$ level.
4. Deactivation of the kerosene heater by means of a solenoid in case such ventilation has failed to improve the indoor air within 90 seconds.

$O_2$ sensor malfunction due to the operation thereof at very low temperatures or towards the end of its useful life result in a sensor output voltage Usensor lower than 30 mV; this condition is indicated by an intermittent buzzer signal comprising e.g. seven beeps for a duration of 90 seconds after the kerosene heater has been deactivated.

The $O_2$ sensor used in the inventive safety apparatus has the following advantages:

1. An extremely long service life (5 to 10 years).
2. Insensitivity to $CO_2$ and other sour components.
3. Enhanced reliability and accuracy because of the relationship existing between an $O_2$ decrease and a CO/$CO_2$ increase due to combustion taking place in poorly ventilated indoor spaces.
4. A possibility exists for setting the alarm voltage Ua of the $O_2$ sensor.
5. Self-contained power supply of the $O_2$ sensor forming a galvanic cell, so that a 3 V DC voltage of the electronic control circuit in the kerosene heater can be maintained.

The only aspect to be kept in mind is that the difference between operating voltage Uo and the voltage corresponding to 0.8% $CO_2$ in the indoor air may be rather slight. As will be seen in the test results shown in the following Table 1, the $O_2$ sensor's alarm voltage Ua is 2 mV. For this reason, stability, a high signal-to-noise ratio as well as a low level of sensitivity to temperature fluctuations call for a high-quality operational amplifier operating at a Ua gain (K) of 100. The accuracy of the $CO_2$ control action depends mainly on voltage drift of the $O_2$ sensor and in the hardware of the electronic control circuit inside the kerosene heater. The $O_2$ sensor in the inventive safety apparatus is rated at 2% of average voltage drift per year.

Assuming an $O_2$ sensor output of 50 mV, the above rating amounts to a drift of one millivolt per year. At Ua=2 mV, and an operating voltage Uo fixed at the factory by means of a potentiometer, the $CO_2$ control action can be expected to be highly reliable over a period of one year.

Inside the test period, the operating voltage Uo will fluctuate slightly on a day to day basis. When the kerosene heater equipped with an $O_2$ sensor is activated in a well-ventilated indoor space, temperature effects will cause the sensor voltage Usensor to rise to approx. 2 mV within a period of 90 min.

The use of a microprocessor in the control system of the inventive safety apparatus enables the aforesaid problems to be solved. With the aid of the microprocessor, it is possible after each burner activation inside the kerosene heater to determine operating voltage Uo as a maximum voltage level before a poor ventilation of the indoor space causes the sensor voltage to decrease. The sensor voltage is checked every 4 minutes and compared to the preceding value. Following determination of the operating voltage Uo, sensor alarm voltage Ua results from the relationship $$Ua = Uo - U'a.$$

TABLE 1

(Analysis of the test results obtained with a type KE-50 oxygen sensor coupled to the microprocessor of the electronic control circuit circuit in the inventive safety apparatus)

| Test No. | $U_o$ (mV) | U O;8% (mV) | ΔU O;8% (mV) | $U_a$ (mV) | $\Delta U_a$ (mV) | $CO_2$ % | $T_{Sensor}$ °C. |
|---|---|---|---|---|---|---|---|
| 1 | 45;70 | 43;83 | 1;87 | 43;71 | 1;99 | 0;875 | 17-37 |
| 2 | 45;52 | — | — | 43;39 | 2;13 | 0;77 | 29-45 |
| 3 | 46;58 | 44;52 | 2;06 | 44;52 | 2;06 | 0;80 | 9-24 |
| 4 | 46;85 | — | — | 44;95 | 1;90 | 0;725 | 8-21 |
| 5 | 46;67 | — | — | 44;70 | 1;97 | 0;75 | 13-25 |
| 6 | 47;55 | 45;1 | 2;45 | 44;16 | 3;39 | 1;18 | 3-25 |
| 7 | 45;39 | 44;0 | 1;39 | 43;83 | 1;56 | 1;09 | — |
| 8 | 47;23 | 45;2 | 2;03 | 44;85 | 2;38 | 0;93 | 3-21 |
| 9 | 45;80 | 44;6 | 1;20 | 44;28 | 1;52 | 1;13 | — |
| 10 | 45;52 | 44;1 | 1;42 | 43;90 | 1;62 | 0;84 | — |
| 11 | 45;76 | 44;17 | 1;59 | 44;12 | 1;64 | 0;845 | — |
| | Average: | | ,1;75 | | 2;01 | 0;903 | |
| Test No. | $U_o$ | U O;8% | U O;8% | | | | |
| 7a | 45;36 | 42;84 | 2;52 | | | | |
| 9a | 44;97 | 42;70 | 2;27 | | | | |
| 10a | 45;41 | 43;40 | 2;01 | | | | |

A determination of operating voltage Uo following each burner activation is advantageous in that it eliminates the influence of any voltage drift on $CO_2$ monitoring. However, problems may arise if the ventilation of an indoor space has not improved after an excessive $CO_2$ level has caused the burner to be turned off and the kerosene heater has wrecklessly been reactivated though the $CO_2$ level in the indoor air was still too high. In that case, the corresponding sensor voltage, which differs from the voltage resulting from a well-ventilated condition of the indoor space, would then be used as the operating voltage Uo in a disadvantageous manner. As a result, shut-down due to an excessive $CO_2$ level would result in a further increase thereof after each activation of the kerosene heater.

This problem may be solved by setting the operating voltage Uo to a fixed level for a period of 45 minutes in case an excessive $CO_2$ level in the indoor air has caused the burner to be shut down. If the burner is re-activated within this period, $CO_2$ control will be based on that fixed operating voltage Uo. It is assumed that the $CO_2$ concentration will have returned to its normal level after 45 minutes so that the operating voltage Uo is again determined in the manner described above.

When the burner flame exceeds its predetermined height range, soot or smoke may be generated and the fire hazard increases. The inventive safety apparatus includes a light sensor associated with the maximim permissible flame size which is located at a corresponding level in the vicinity of the combustion chamber of the kerosene heater. This sensor cooperates with the electronic control circuitry in the inventive safety apparatus to provide the required control functions such as:

1. A timeout of about 3 seconds to override transients;
2. Generation of an intermittent acoustic alarm signal (such as 5 tones) if the height of the burner flame exceeds the top limit of the predetermined flame height range; and
3. Automatic burner shut-down if the flame height has not returned to the predetermined flame height range within a period of e.g. 60 seconds following the triggering of an alarm signal.

In a poorly ventilated indoor space, operation of the kerosene heater with too high a burner flame causes an oxygen deficiency, incomplete combustion and thus increased CO-$CO_2$ levels in the indoor air. In this situation, the $O_2$ sensor included in the inventive safety apparatus provides a monitoring action in addition to that effected by the light sensor.

When the burner is shut down automatically, it is important to prevent the smoke and the accompanying smell the heaters equipped with conventional safety devices generate.

The inventive process and the inventive safety apparatus guarantee an automatic shut down of the burner in a manner that the generation of the aforesaid smell will be minimized.

The inventive safety apparatus ensures a smell-preventing automatic shut-down of the burner by the following sequence of steps: The rotary knob of the burner's wick adjusting device is set to a very low flame height; the correct setting is indicated by a colored marker and an intermittent acoustic signal for a duration of approx. 3 seconds. With the burner adjusted to this wick setting, the burner will continue to operate e.g. for another 4 minutes so as to prevent the emission of smell-forming components. This period allows the heating pipe and the burner head to cool down sufficiently.

Thereafter, a solenoid in the shut-down means is energized to deactivate the burner with a minimum of smell being developed. The cooling period may be terminated at any time by turning the wick up by means of the control knob of the burner wick adjustor device.

The inventive safety apparatus includes a replaceable set of batteries to supply power to all electric power consuming elements inside the kerosene heater, such as the ignition coil, the electronic control circuitry including the microprocessor, and the heater element associated with the CO sensor.

Turning the wick adjusting device in a clockwise direction causes the main switch to be activated to close the electronic control circuit. Initially, the battery is tested. If battery voltage Ub is lower than 2.3 V, ignition will not be possible and the buzzer will sound a continuous signal for about 30 seconds to indicate that the battery should be replaced. After 30 seconds, the alarm signal is discontinued and the process of warming up or heating the kerosene heater discontinued by a solenoid acting to reset the wick.

With the battery voltage in its normal range, ignition will be possible and must take place within e.g. 15 seconds. If it does not, an intermittent buzzer signal will be sounded for e.g. 90 seconds; during that period, it is still possible to ignite the heater. If ignition has not been effected after 90 seconds, the solenoid resets the heater to its deactivated condition.

After ignition has been effected, a periodic monitoring cycle is started wherein the battery voltage is checked in the aforesaid manner; also, both flame height and $CO_2$ concentration in the off-gas are checked 4 min. after the initial warm-up of the kerosene heater.

In the inventive safety apparatus, it has turned out to be advantageous that the frequency of the microprocessor can be selected to reduce the power consumption of the electronic control circuitry. The microprocessor operates satisfactorily between 0.5and 5 MHz. At a frequency f=0.5 MHz, current I as selected is 2.5 mA and increases to I=30 mA at f=5 MHz. At f=0.5 MHz, the microprocessor operates much more slowly than at f=5 MHz; in the present application this difference is totally inconsequential, however.

It should be noted also that the inventive safety apparatus includes a mechanism mounted inside the housing of the kerosene heater which prevents the burner igniting means and the wick adjusting means from operating in case the battery is missing or has been improperly placed into the battery case.

The fuel level is monitored in a continuous manner at the bottom of the fuel tank by means of conventional circuitry. If the level is too low, an intermittent buzzer signal will be emitted together with a flashing bottom light for a time of e.g. 3 minutes. The amount of fuel available at the tank bottom in this condition is sufficient to keep the burner operating for another 30 minutes or so.

BRIEF DESCRIPTION OF THE DRAWINGS

The inventive process and the inventive safety apparatus for practicing said process will now be explained with reference to the drawings, wherein.

DESCRIPTION OF THE PREFERRED EMBODIMENTS

Figure 1:
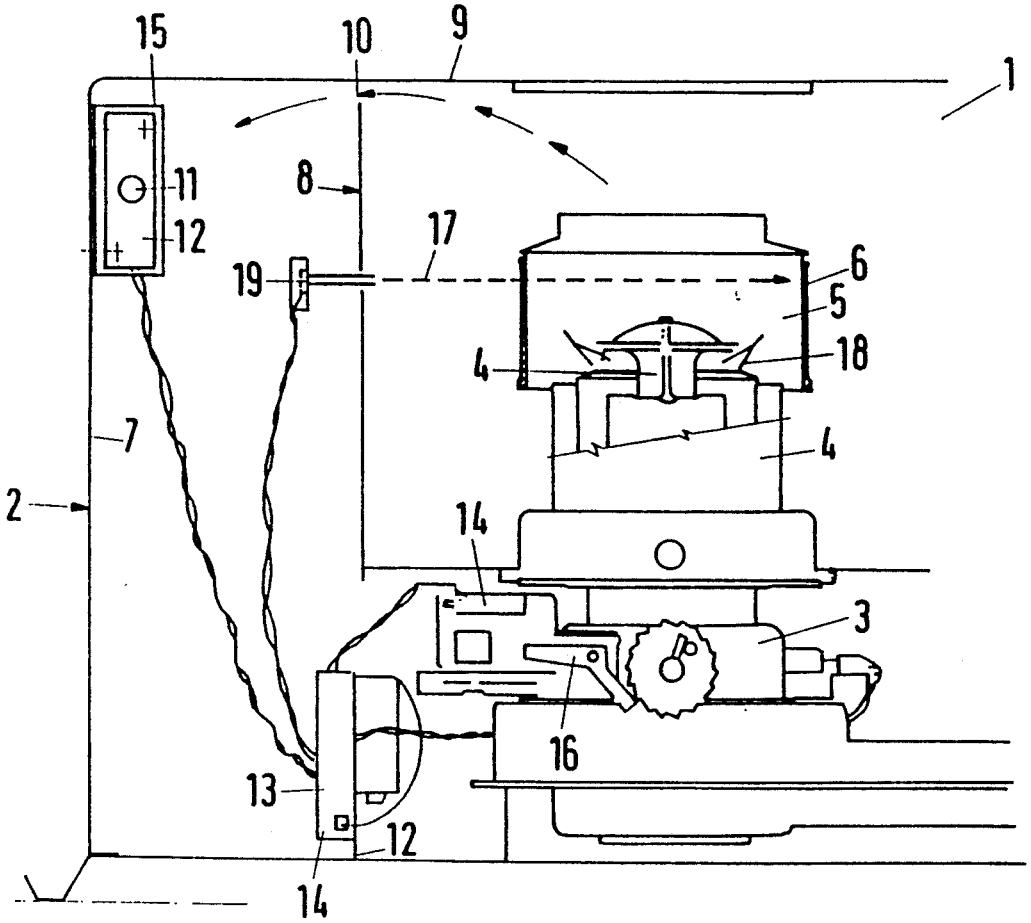
FIG. 1 is a schematic view in section of a kerosene heater equipped with the inventive safety apparatus.
Figure 2:
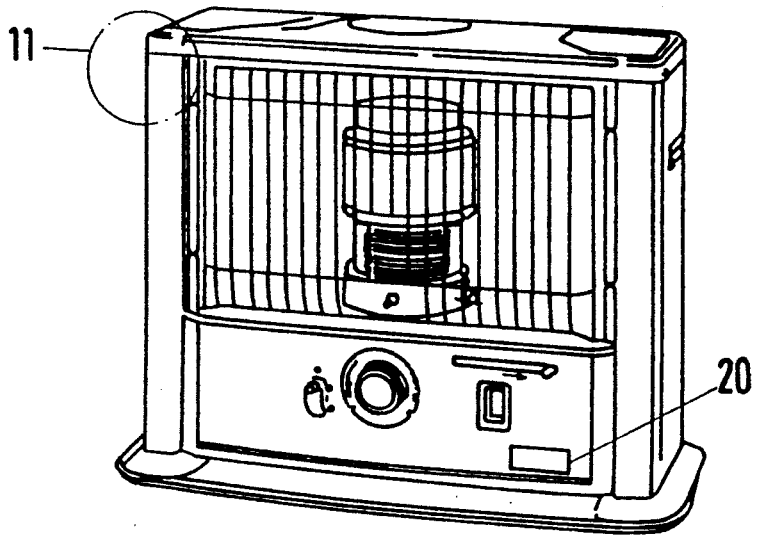
FIG. 2 is a view in perspective of the kerosene heater in FIG. 1.

As shown in FIGS. 1 and 2, kerosene heater 1 has a housing 2 wherein is centrally mounted a burner 4 having wick adjusting means 3 associated therewith; the burner may be a one- or two-stage design. Further, the heater has a burner housing 6 which is perforated and open at the top and defines a combustion chamber 5. Between burner housing 6 and rear wall 7 of housing 2 of kerosene heater 1 (on the left in FIG. 1), there is mounted a vertically downwardly extending reflecting screen 8 which has, adjacent top wall 9 of housing 2 of kerosene heater 1, an opening 10 through which may flow a portion of the off-gases emitted by burner 4 and escaping upwardly therefrom (arrow A). A vertical holder 12 secured to the bottom of housing 2 supports, in the lower regions of the housing, an $O_2$ sensor 13 in the form of a galvanic cell coupled to a microprocessor included in an electronic control circuit 14. Behind heat reflecting screen 8, there is mounted in the upper left corner (in FIG. 1) of housing 2 a CO sensor 11 on a CO monitoring circuit board 15 in such a manner that it will be contacted by the off-gases escaping through opening 10 in heat reflecting screen 9. Board 15 is held on another vertical support 12. Circuit board 15 is connected electrically to electronic control circuit 14 of the safety apparatus, which in turn is coupled to warning signal means (not shown) and automatic shut-down means 16 for burner 4. A light sensor 19 associated with an upper or top limit 17 of a predetermined range of the height of the flame 18 produced by burner 4 is mounted behind heat reflecting screen 8 in a manner to detect flames higher than top limit 17 of the aforesaid predetermined flame height range. Light sensor 19 is coupled to electronic control circuit 14. When light sensor 19 detects flames 18 higher than top limit 17 of the aforesaid flame height range, it provides a measuring signal which is supplied to electronic control circuit 14 to trigger an acoustic warning signal. The user of the kerosene heater has 90 seconds now to actuate wick adjusting means 3 so as to return flames 18 of burner 4 to the predetermined flame height range in accordance with the normal operating condition of burner 4. Failure to effect such a return within the aforesaid 90 seconds causes shut-down means 16 to be activated by electronic control circuit 14 and burner 4 to be automatically deactivated.

Figure 3:
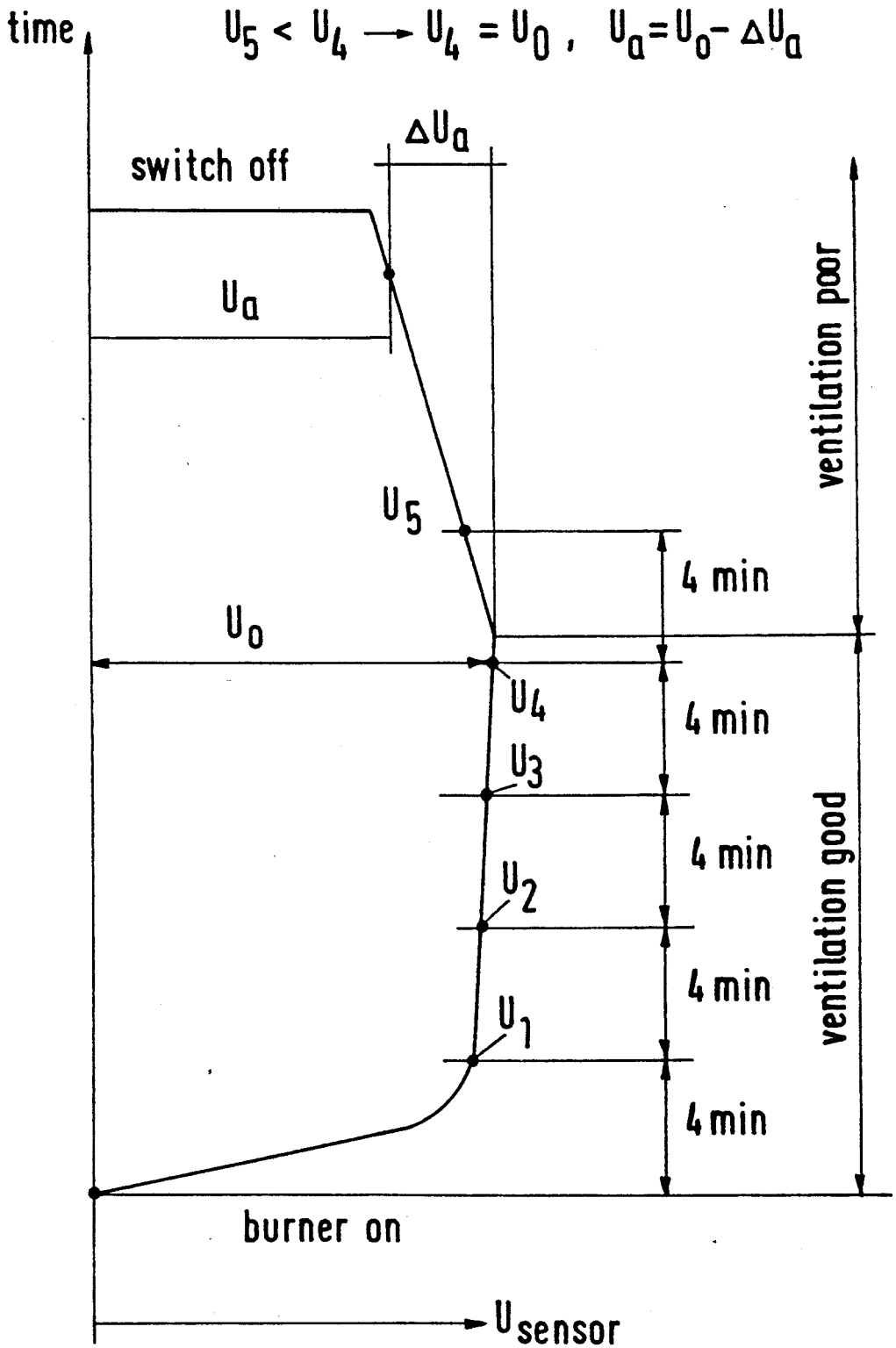
FIG. 3 is a plot showing the manner of determining sensor operating voltage Uo.

If kerosene heater 1 is turned on in a properly ventilated indoor space, the influence of the ambient temperature will cause output Usensor from $O_2$ sensor 13 in the safety apparatus to increase to approx. 2 mV within 90 minutes. While kerosene heater 1 is operating, $O_2$ sensor 13 continuously detects the $O_2$ concentration of the air inside housing 2 and converts that concentration to a corresponding voltage signal. Since a decrease in $O_2$ relates directly to an increase in $CO_2$, the voltage signal indicating the $O_2$ concentration is a measure of the instantaneous amount of $CO_2$ in the indoor air. As shown in FIG. 3, the microprocessor in the electronic control circuit 14 proceeds after an activation of burner 4 to determine operating voltage Uo of $O_2$ sensor 13 as a maximum before poor ventilation of the indoor space causes sensor voltage Usensor to decrease. As shown in FIG. 3, sensor voltage Usensor is detected every 4 min. and compared with the preceding value. In FIG. 3, U4 is the maximum voltage level existing before poor ventilation of the indoor space causes Usensor to decrease (see $U5 < U4$). For this reason, $U4 = Uo$. After the operating voltage has been determined, alarm voltage Ua of $O_2$ sensor 13 follows to be $Ua = Uo - U'a$. If the oxygen concentration detected by $O_2$ sensor 13 corresponds to the voltage level of alarm voltage Ua, an alarm signal will be generated. If the ventilation in the indoor space does not improve within 90 seconds, the $O_2$ concentration will continue to decrease and the kerosene heater will be shut down by automatic shut-down means 16, which comprises a solenoid, at an output Usensor from $O_2$ sensor 13 which is lower than alarm voltage Ua.

Figure 4:
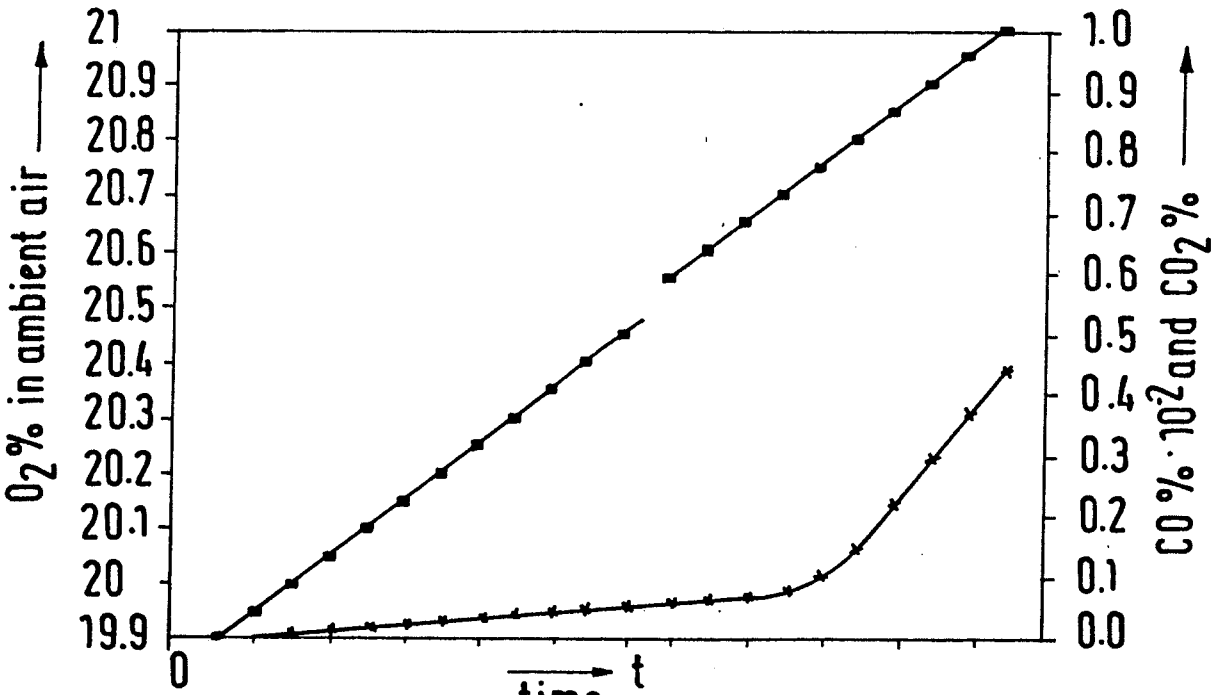
FIG. 4 plots the oxygen in the indoor air versus time and CO—$CO_2$ concentration.

While kerosene heater 1 operates, CO sensor 11 is capable of continuously detecting the CO concentration in the off-gas (arrow A) from burner 4 in housing 2, with the measured CO concentration continuously converted to a corresponding electrical voltage by the electronic CO monitoring circuitry. At the same time, the CO concentration can be used as a measure for the $CO_2$ concentration in the indoor air. The diagram of FIG. 4 shows the CO and $CO_2$ concentration relative to the oxygen percentage in the indoor air versus the operating time of kerosene heater 1. As may seen, the direct interrelationship between a decrease of $O_2$ and an increase of $CO_2$ establishes a corresponding relationship between the $O_2$ decrease and a CO decrease through the relationship between the increase of $CO_2$ and CO.

Figure 5:
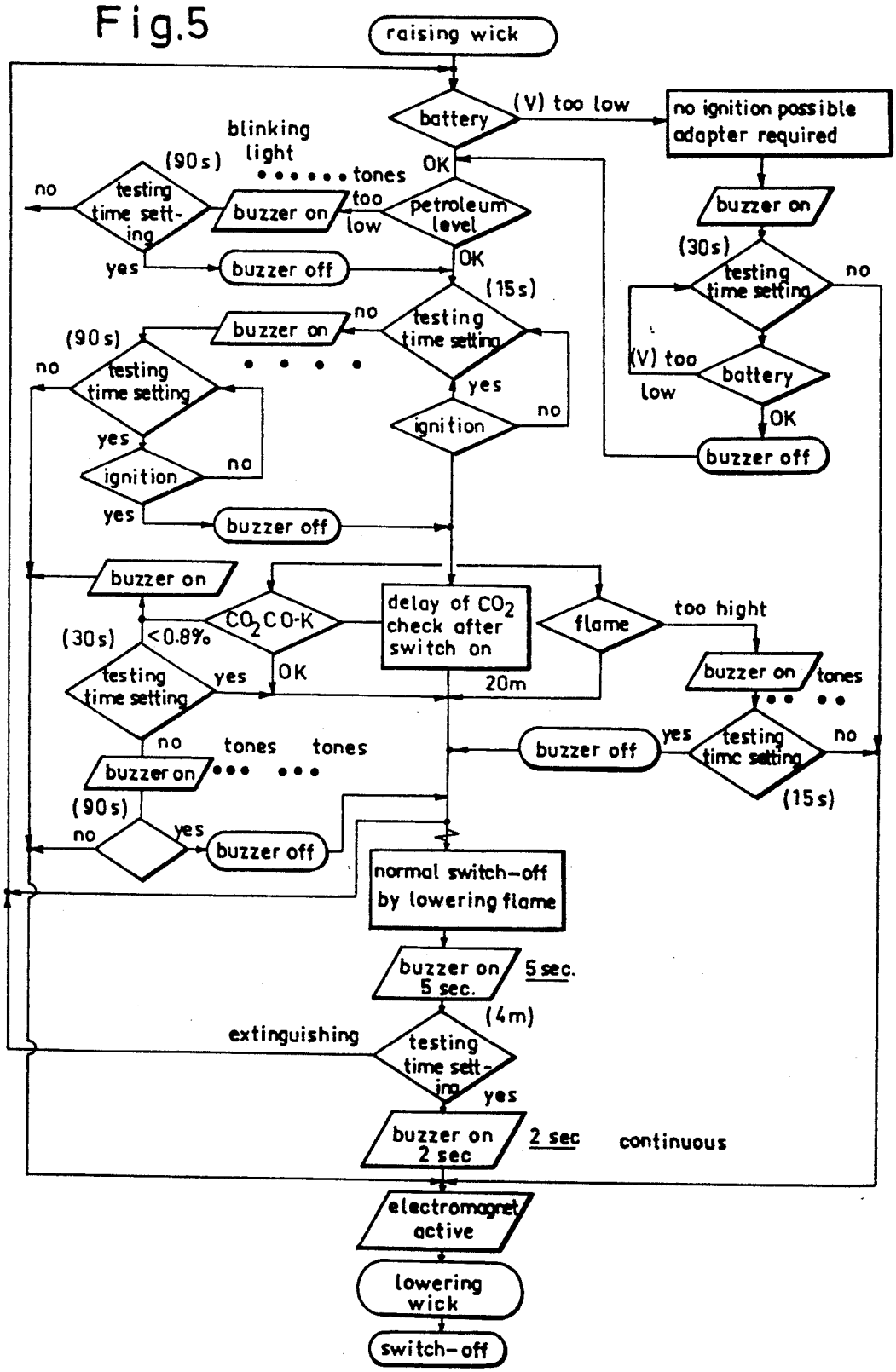
FIG. 5 is a block diagram showing the process of monitoring the operation of the kerosene heater and ensuring the safety thereof.

The block diagram of FIG. 5 shows the various process steps for monitoring and maintaining the safety of the operation of a kerosene heater within an indoor space both in the normal heating mode and outside such mode, with the blocks referred to showing the functional interrelationship that exists between the various process measures.

Figures 6A, 6B:
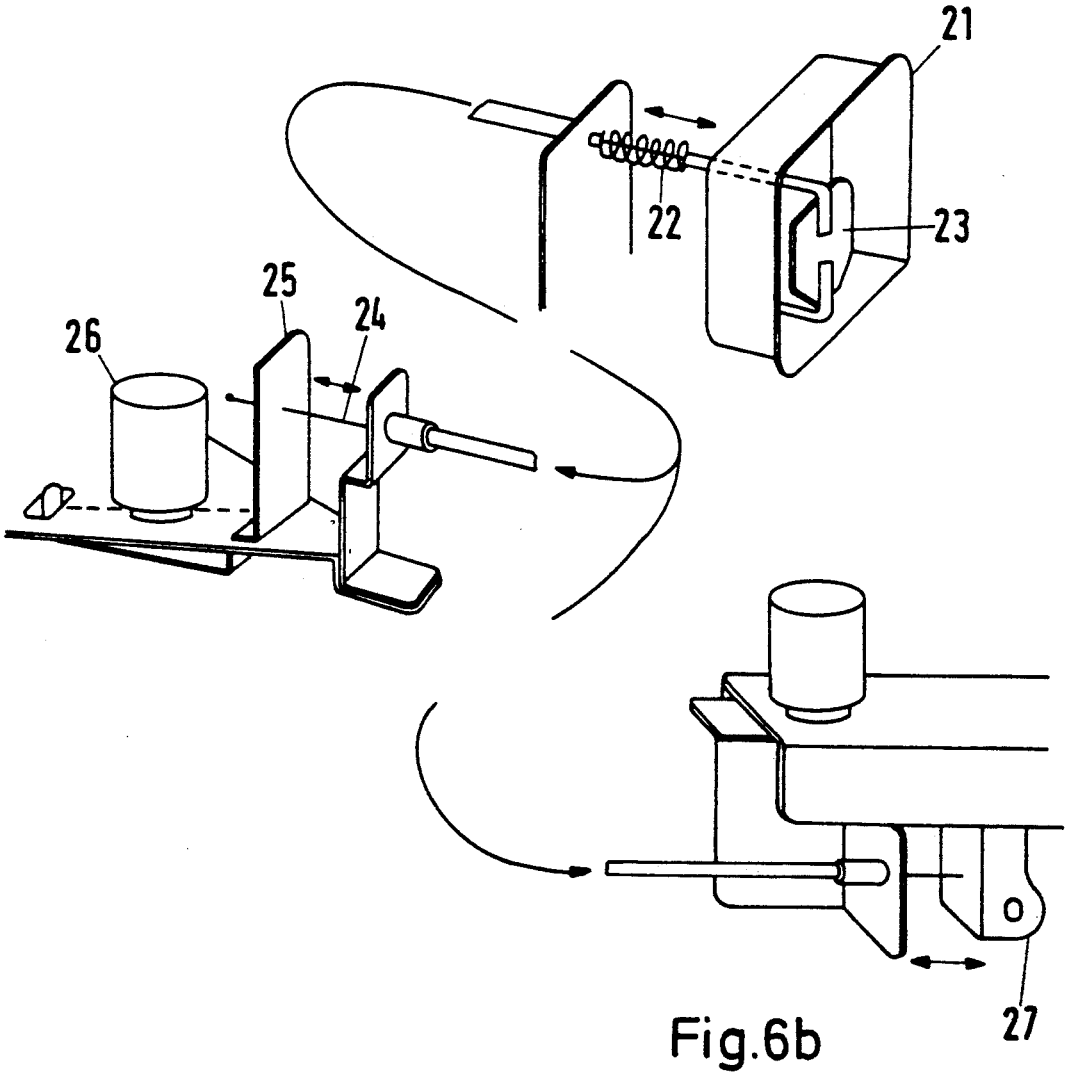
FIGS. 6*a* and 6*b* are views in perspective of two embodiment examples of a mechanism included in the inventive safety apparatus to prevent burner ignition or operation of the wick setting means if the battery is missing or has been placed improperly in the battery case.

FIGS. 6*a* and 6*b* show two embodiments of a mechanism included in the safety apparatus to block the ignition means for burner 4 and the wick adjusting means 3—and thus the ignition of the wicks by means of a match—in case battery is missing or improperly seated in battery case 21.

The aforesaid mechanism comprises a functional spring 22 which assumes a compressed condition when the battery is properly seated, i.e. when it contacts a sensor plate 23 inside battery case 21, with a trigger wire 24 (FIG. 6*a*) having its two ends connected to trigger plate 25 of a safety device 26 responsive to vibrations (including earthquake tremors) and to sensor plate 23, respectively, being slack so that burner 4 may be ignited. If the battery is removed from battery case 21 or does not properly contact sensor plate 23, the latter is urged forwardly by the compressed functional spring 22, causing trigger wire 24 to be stretched taut and moving trigger plate 25 so that safety device 26 will be activated to prevent ignition or to block the wick adjusting mechanism or to shut down burner 4. In the embodiment of FIG. 6*b*, trigger plate 25 of safety device 26 is replaced by a latch 27 having one end of trigger wire 24 connected thereto to actuate latch 27 when functional spring 22 is moved so as to trigger safety device 26.

I claim:

1. A process for monitoring and ensuring safe operation of an unvented heater in an indoor space, the heater having a burner for producing a flame having a height within a selected range below an upper limit and above a lower limit during a normal heating condition, the burner flame producing off-gases, the heater also having flame adjusting means responsive to control signals for adjusting the height of the flame, and shut down means responsive to control signals for extinguishing the flame, the heater including a housing containing the burner, the selected range, the adjusting means and the shut down means, the process comprising:

sensing $O_2$ percentage in the burner off-gases inside the heater housing which is proportional to an amount of $CO_2$ in the burner off-gases, the detected $O_2$ percentage being in the form of a first voltage signal useable as a control signal;

sensing CO concentration in the burner off-gases inside the heater housing which is also proportional to the amount of $CO_2$ in the off-gases, the CO concentration being in the form of a second voltage signal which is useable as a control signal;

monitoring radiation from the flame to determine when the flame height is within the selected range, to generate an additional control signal when the flame height is outside the selected range in the form of a third voltage signal which can be used as the control signal;

when the third voltage signal indicates a flame height outside the selected range for a predetermined period of time, generating an alarm signal and if the third voltage signal continues to indicate a flame height outside the selected range for a selected amount of additional time, operating the shut down means to extinguish the flame;

generating an alarm signal if the first voltage signal indicates a first elevated $CO_2$ amount for a first selected time period;

activating the shut down means to extinguish the flame if the first voltage signal indicates a second elevated $CO_2$ amount which is above the first elevated $CO_2$ amount, after a selected time period which is greater than the first selected time period;

generating the alarm signal when the second voltage signal indicates the first elevated $CO_2$ amount after a third selected time period; and activating the shut down means to extinguish the flame if the second voltage signal indicates the second elevated $CO_2$ amount after a fourth selected time period which is greater than the third selected time period, so that an alarm and subsequent shut down may take place based on the $O_2$ percentage and on the CO concentration in the off gases in the heater housing.

2. A process according to claim 1, wherein the first elevated $CO_2$ amount is 0.8 percent, the second and fourth time periods being approximately 90 seconds each.

3. A process according to claim 1, including using an $O_2$ monitor for sensing the $O_2$ percentage in the off-gases, the $O_2$ monitor having an operating voltage (Uo) which is selected when the burner flame is first lit to be indicative of an $O_2$ percentage corresponding to an acceptably low $CO_2$ amount, and maintaining the setting of the operating voltage for a predetermined length of time after the flame has been extinguished and relit.

4. A process according to claim 3, wherein the predetermined length of time is approximately 45 minutes.

5. A process according to claim 1, including sensing the $O_2$ percentage in the off-gases by periodically measuring the first voltage signal and measuring a difference between one first voltage signal after another during each cycle for measuring changes in the $O_2$ percentage corresponding to changes in the $CO_2$ concentration.

6. A process according to claim 5, including taking the first voltage signal about every four minutes.

7. A process according to claim 1, including receiving the control signals and applying them to the shut down means and for generating the alarm signals using an electronic control circuit which is battery operated, the process including checking a battery voltage of the battery operated electronic control circuit and, if the battery voltage falls below a selected battery voltage, generating an alarm signal and precluding ignition of the burner flame.

8. A process according to claim 7, including detecting the absence of any battery voltage and upon such absence, precluding ignition of the burner flame.

9. A process according to claim 8, including mechanically precluding ignition of the burner flame in the absence of any battery voltage.

10. A process according to claim 1, wherein the heater includes fuel at a fuel level, the process including detecting the fuel level and when the fuel level falls below a selected value, generating an intermittent alarm signal.

11. An apparatus for monitoring and ensuring safe operation of an unvented heater in an indoor space, the heater having a burner for producing a flame having a height within a selected range below an upper limit and above a lower limit during a normal heating condition, the burner flame producing off-gases, the heater also having flame adjusting means responsive to control signals for adjusting the height of the flame, and shut down means responsive to control signals for extinguishing the flame, the heater including a housing containing the burner, the selected range, the adjusting means and the shut down means, the apparatus comprising:

an $O_2$ sensor at a bottom of said housing for sensing $O_2$ percentage in the burner off-gases inside the heater housing, the $O_2$ percentage being proportional to an amount of $CO_2$ in the burner off-gases, the detected $O_2$ percentage being in the form of a first voltage signal useable as a control signal;

a CO sensor for sensing CO concentration in the burner off-gases inside the heater housing which is also proportional to the amount of $CO_2$ in the off-gases, the CO concentration being in the form of a second voltage signal which is useable as a control signal, said CO sensor being at a top of said housing;

a reflecting screen between said CO sensor and the burner for shielding the CO sensor from radiation of the burner, the screen having an opening for allowing the passage of off-gases from the flame to the CO sensor;

a light sensor for monitoring radiation from the flame to determine when the flame height is within and outside from the selected range, to generate an additional signal when the flame height is outside the selected range, in the form of a third voltage signal which can be used as the control signal;

vibration protection means for generating a forth voltage signal for use as a control signal; and electronic control circuit means connected to said $O_2$ sensor, said CO sensor, said light sensor, said vibration protection means, said adjusting means and said shut down means, said circuit means receiving the signals and applying the signals to the adjusting means for activating the adjusting means to change the burner flame height to be within the selected range and to generate the alarm signals and to control the shut down means for extinguishing the burner flame so that when the third voltage signal indicates a flame height outside the selected range for a predetermined period of time, an alarm signal is generated and if the third voltage signal continues to indicate a flame height outside the selected range for a selected amount of additional time, operating the shut down means to extinguish the flames, the circuit means generating an alarm signal if the first voltage signal indicates a first elevated $CO_2$ amount for a first selected time period, and activating the shut down means to extinguish the flame if the first voltage signal indicates a second elevated $CO_2$ amount which is above the first elevated $CO_2$ amount, after a second selected time period which is greater than the first selected time period, the circuit means also generating the alarm signal when the second voltage signal indicates the first elevated $CO_2$ amount after a third selected time period, and activating the shut down means to extinguish the flame if the second voltage signal indicates the second elevated $CO_2$ amount after a fourth selected time period which is greater than the third selected time period, so that an alarm and subsequent shut down may take place based on the oxygen percentage and on the CO concentration in the off gases in the heater housing.

12. An apparatus according to claim 11, wherein the electronic control circuit means is battery operated, the apparatus including absent battery sensing means operatively connected to the vibration protection means for precluding ignition of the flame in the absence of a battery.

13. An apparatus according to claim 12, wherein said absent battery sensing means comprises a battery case for receiving a battery, a sensor plate for engagement against the battery in the battery case a spring operatively engaged with the sensor plate, and a triggering wire operative connected between the spring and the vibration protection means for influencing the vibration protection means in the absence of a battery to preclude ignition of the flame.

14. An apparatus according to claim 13, including a trigger plate connected to said triggering wire and operatively connected to said vibration protection means to operate said vibration protection means for precluding ignition of the flame.

15. An apparatus according to claim 13, including a pivotable latch connected to said wire and operatively connected to said vibration protection means for movement in the absence of a battery to operate said vibration protection means to preclude ignition of the flame.

* * * * *